US009069299B2

(12) United States Patent
Tanaka

(10) Patent No.: US 9,069,299 B2
(45) Date of Patent: Jun. 30, 2015

(54) IMAGE HEATING APPARATUS AND IMAGE FORMING APPARATUS

(71) Applicant: CANON KABUSHIKI KAISHA, Tokyo (JP)

(72) Inventor: Kenichi Tanaka, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/095,229

(22) Filed: Dec. 3, 2013

(65) Prior Publication Data

US 2014/0153966 A1 Jun. 5, 2014

(30) Foreign Application Priority Data

Dec. 4, 2012 (JP) ..... 2012-265209

(51) Int. Cl.
*G03G 15/16* (2006.01)
*G03G 15/20* (2006.01)

(52) U.S. Cl.
CPC ..... *G03G 15/2028* (2013.01)

(58) Field of Classification Search
CPC ..... G03G 15/2028; G03G 15/55; G03G 15/6529; G03G 21/1647; G03G 21/1871; G03G 2215/0141; G03G 15/162; G03G 15/2003; G03G 15/2017; G03G 15/2042; G03G 15/2053; G03G 15/2064; G03G 15/235
See application file for complete search history.

(56) References Cited

U.S. PATENT DOCUMENTS

| | | | | |
|---|---|---|---|---|
| 4,475,804 | A * | 10/1984 | Kanno et al. | 399/323 |
| 7,751,767 | B2 * | 7/2010 | Burton et al. | 399/323 |
| 8,195,074 | B2 * | 6/2012 | Ishikawa | 399/323 |
| 8,655,242 | B2 | 2/2014 | Tanaka | |
| 2013/0078016 | A1 * | 3/2013 | Koyama et al. | 399/328 |
| 2013/0140141 | A1 | 6/2013 | Tanaka | |

FOREIGN PATENT DOCUMENTS

| | | | |
|---|---|---|---|
| JP | 60-247672 | A | 12/1985 |
| JP | 2007-094327 | A | 4/2007 |

* cited by examiner

*Primary Examiner* — Roy Y Yi
(74) *Attorney, Agent, or Firm* — Fitzpatrick, Cella, Harper & Scinto

(57) ABSTRACT

An image heating apparatus includes an image heating unit including a pair of rotatable members between which a sheet is nipped and fed while heating a toner image thereon; and a retracting unit retractable from the image heating unit, the retracting unit including an air discharging portion configured to discharge air for separating the sheet from the rotatable member, and a feeding portion provided with a pair of rotatable members and configured to nip and feed therebetween the sheet heated by the image heating unit.

12 Claims, 9 Drawing Sheets

IMAGE HEATING APPARATUS AND IMAGE FORMING APPARATUS

FIELD OF THE INVENTION AND RELATED ART

The present invention relates to an image heating apparatus for heating the toner image on a sheet of recording medium. It is related also to an image forming apparatus equipped with the image heating apparatus.

In the field of an electrophotographic image forming apparatus, it has been a common practice to equip an image forming apparatus with a fixing apparatus (image heating apparatus) to fix an unfixed toner image formed on a sheet of recording medium by the image forming apparatus. The image fixing apparatus is equipped with a pair of rotational members, and fixes the toner image on the sheet of recording medium by applying heat and pressure to the sheet of recording medium and the unfixed toner image thereon while conveying the sheet through the nip formed by the pair of rotational members, with the sheet being sandwiched by the pair of rotational members.

In the case where a thin sheet of recording medium, which is relatively small in rigidity, is used as recording medium, that is, in the case where a thin sheet of recording medium is conveyed through a fixing device such as the one described above, it is possible that as the sheet is conveyed out of the nip of the fixing device, the sheet will fail to separate from one of the pair of rotational members, and therefore, continue to rotate with the rotational member. If this phenomenon occurs, the fixing device becomes jammed (recording medium gets stuck in fixing device). Consequently, it becomes necessary for the ongoing image forming operation (fixing operation) to be interrupted.

Thus, there has been proposed to provide a fixing apparatus (device) with a mechanism (air blower) for blowing air at the rotational member(s), which is placed in the adjacencies of the pair of rotational members to blow air at the rotational members to force the sheet of recording medium to separate from the rotational member as the sheet is conveyed out of the aforementioned nip of the fixing apparatus (device).

An example of a fixing apparatus (device) equipped with an air blowing mechanism such as the above described one is disclosed in Japanese Laid-open Patent Application Sho60-247672. According to this patent application, the fixing apparatus (device) is provided with a cylindrical member having multiple small holes. This cylinder member is connected to a pump so that the high pressure air is blown at the rotational member through the multiple small holes of the cylindrical member.

Another example of a fixing apparatus (device) equipped with an air blowing mechanism such as the one described above is disclosed in Japanese Laid-open Patent Application 2007-094327. According to this patent application, the fixing device is provided with an air nozzle, and a small fan placed in the adjacencies of the air nozzle, and is structured so that the air flow generated by the fan is made to blow at the rotational member through the air nozzle.

The fixing device such as these disclosed in the abovementioned Japanese Laid-open Patent Applications, however, is problematic even though it is equipped with an air blowing mechanism. More concretely, even if a fixing device is equipped with an air blowing mechanism, it is possible that the fixing device will be jammed by a sheet of recording medium which happens to remain stuck to the rotational member for an unexpected reason. If a sheet of recording medium remains stuck to the rotational member, it has to be removed.

As described above, the air blowing mechanism is disposed in the adjacencies of the rotational member. Therefore, unless the air blowing mechanism is displaced, it is rather difficult to find on the downstream side of the nip of the fixing device, a space which is large enough for removing the sheet of recording medium stuck to the rotational member; it is difficult to remove the jammed sheet of recording medium.

SUMMARY OF THE INVENTION

According to an aspect of the present invention, there is provided a image heating apparatus comprising an image heating unit including a pair of rotatable members between which a sheet is nipped and fed while heating a toner image thereon; and a retracting unit retractable from said image heating unit, said retracting unit including an air discharging portion configured to discharge air for separating the sheet from said rotatable member, and a feeding portion provided with a pair of rotatable members and configured to nip and feed therebetween the sheet heated by said image heating unit.

According to another aspect of the present invention, there is provided an image forming apparatus comprising a main assembly of the apparatus provided with an air supply portion configure to supply air, and a main assembly side connector connected with said air supply portion; an image heating unit including a pair of rotatable members between which a sheet is nipped and fed while heating a toner image thereon; a retracting unit retractable from said image heating unit, said retracting unit including an air discharging portion configured to discharge air for separating the sheet from said rotatable member, and a feeding portion provided with a pair of rotatable members and configured to nip and feed therebetween the sheet heated by said image heating unit; a drawing unit supporting said image heating unit and said retracting unit and drawable relative to said main assembly of the apparatus; and a unit side connector provided on said retracting unit and connectable with said main assembly side connector with an operation of inserting said drawing unit into said main assembly of the apparatus.

Further features of the present invention will become apparent from the following description of exemplary embodiments of with reference to the attached drawings.

DESCRIPTION OF THE PREFERRED EMBODIMENTS

Hereinafter, embodiments of the present invention are described in detail with reference to the appended drawings.

(Image Forming Apparatus)

Figure 1:
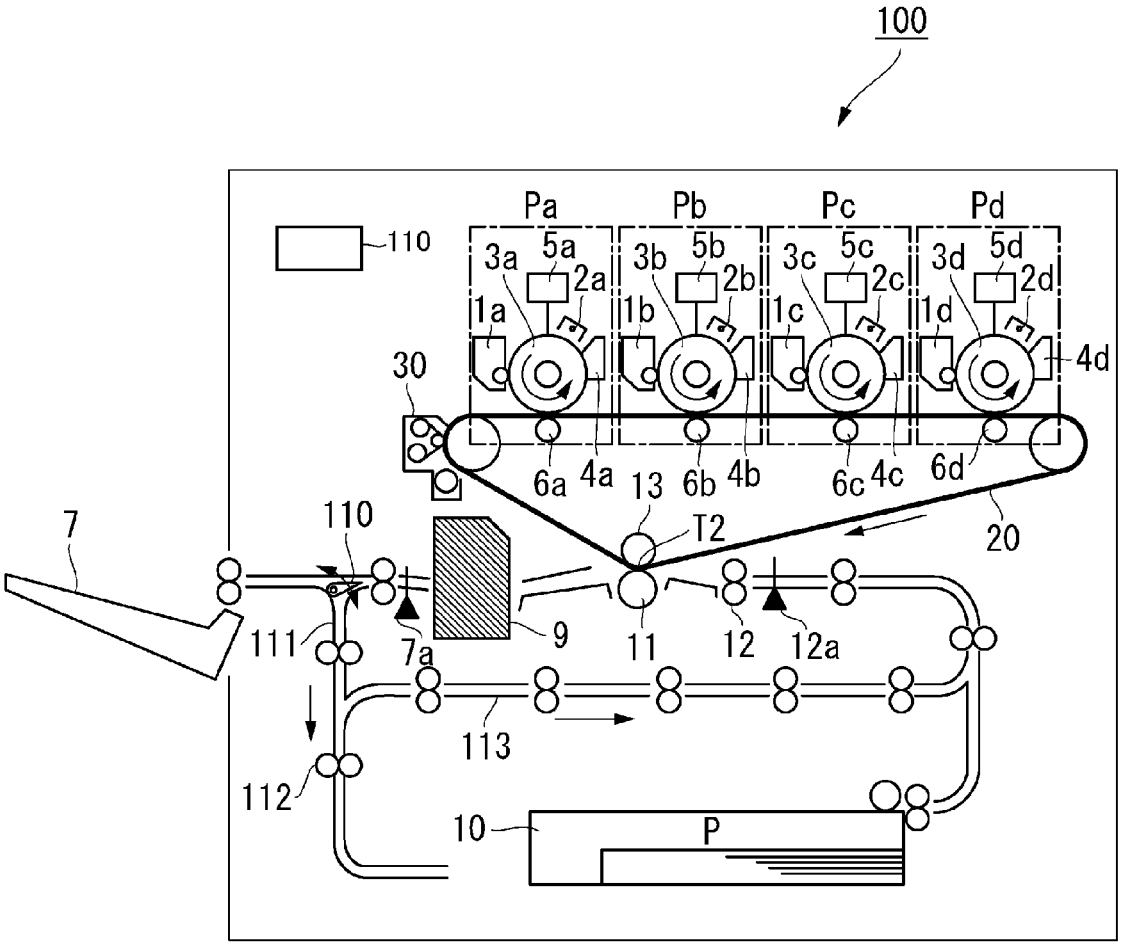
FIG. 1 is a schematic sectional view of a typical image forming apparatus to which the present invention is applicable, and shows the general structure of the apparatus.

FIG. 1 is a schematic sectional view of a typical image forming apparatus to which the present invention is related. It shows the structure of the apparatus. Referring to FIG. 1, the image forming apparatus 100 is a full-color printer of the so-called tandem type, and also, of the intermediary transfer type. More concretely, the image forming apparatus 100 has: an intermediary transfer belt 20; and four image forming stations Pa, Pb, Pc and Pd, which form monochromatic yellow, magenta, cyan, and black images, respectively. It is structured so that the four image forming stations Pa, Pb, Pc and Pd are aligned in tandem along the intermediary transfer belt 20 in the moving direction of the intermediary transfer belt 20. The intermediary transfer belt 20 is an example of a medium onto which a toner image formed in each image formation station is transferred, and from which the toner image is transferred onto a sheet of recording medium.

In the image forming station Pa, a yellow toner image is formed on the photosensitive drum 3*a*, and is transferred onto the intermediary transfer belt (primary transfer). In the image formation station Pb, a magenta toner image is formed on the photosensitive drum 3*b*, and is transferred onto the intermediary transfer belt 20 (primary transfer). In the image formation stations Pc and Pd, cyan and black toner images are formed on the photosensitive drums 3*c* and 3*d*, respectively, and are transferred onto the intermediary transfer belt 20 (primary transfer).

Sheets P of recording medium are taken out of a recording medium cassette 10 one by one, and each sheet P is conveyed to a pair of registration roller 12, by which it is kept on standby. Then, the registration rollers 12 convey the sheet P of recording medium to the secondary transfer station T2 of the image forming apparatus, with such a timing that the sheet P arrives at the secondary transfer station T2 at the same time as the toner image(s) on the intermediary transfer belt 20. Then, the sheet P is conveyed through the secondary transfer station T2. While the sheet P is conveyed through the secondary transfer station T2, the four monochromatic toner images, different in color, on the intermediary transfer belt 20 are transferred (secondary transfer) onto the sheet P of recording medium. Then, the sheet P is conveyed to, and through, the fixing device (image heating device) 9. While the sheet P is conveyed through the fixing device 9, the sheet P and the monochromatic toner images thereon are subjected to heat and pressure. Consequently, the images are fixed to the sheet P. Then, the sheet P is discharged into the delivery tray 7, which is outside the main assembly of the image forming apparatus 100.

When the image forming apparatus 100 is in the two-sided printing mode, the sheet P of recording medium is guided into the reversal passage 111 by the flapper 110, and then, is sent into the two-sided printing passage 113 by the reverse roller 112. Then, the sheet P is conveyed by the pair of registration rollers 12 into the secondary transfer station T2 for the second time, so that another set of monochromatic toner images are transferred onto the second surface of the sheet P. Then, the sheet P is sent into the fixing device 9, in which the toner images are fixed to the second surface of the sheet P.

The four image formation stations Pa, Pb, Pc and Pd are practically the same in structure, although they are different in the color of the toner used therein, in that the developing devices 1*a*, 1*b*, 1*c* and 1*d* use yellow, magenta, cyan, and black toners in the stations Pa, Pb, Pc and Pd, respectively. Hereafter, therefore, only the image formation station Pa is described not to repeat the same description.

The image formation station Pa is made up of the photosensitive drum 3*a*, and drum processing devices, more concretely, a charging device 2*a* of the corona type, an exposing device 5*a*, the developing device 1*a*, a primary transfer roller 6*a*, and a drum cleaning device 4*a*, which are disposed in the adjacencies of the peripheral surface of the photosensitive drum 3*a*. The photosensitive drum 3*a* is made up of an aluminum cylinder, and a photosensitive layer formed on the peripheral surface of the aluminum cylinder.

The charging device 2*a* of the corona type uniformly charges the peripheral surface of the photosensitive drum 3*a*. The exposing device 5*a* writes an electrostatic image which reflects the image to be formed, by scanning the peripheral surface of the photosensitive drum 3*a* with a beam of laser light. The developing device 1*a* develops the electrostatic image on the peripheral surface of the photosensitive drum 3*a* into a toner image, that is, a visible image formed of toner. The primary transfer roller 6*a* transfers (primary transfer) the toner image on the photosensitive drum 3*a* onto the intermediary transfer belt 20, by being provided with a preset voltage.

The secondary transfer roller 11 forms the secondary transfer station T2 by being pressed upon the intermediary transfer belt 20 which is backed by a belt backing roller 13. The drum cleaning device 4*a* has a cleaning blade, the cleaning edge of which is placed in contact with the peripheral surface of the photosensitive drum 3*a* to recover the primary transfer residual toner, that is, the toner having escaped from being transferred onto the intermediary transfer belt 20 and remaining adhered to the peripheral surface of the photosensitive drum 3*a* after the primary transfer. The belt cleaning device 30 recovers the secondary transfer residual toner, that is, the toner remaining on the outward surface of the intermediary transfer belt 20 after the secondary transfer.

Embodiment 1

Fixing Device

Figure 2:
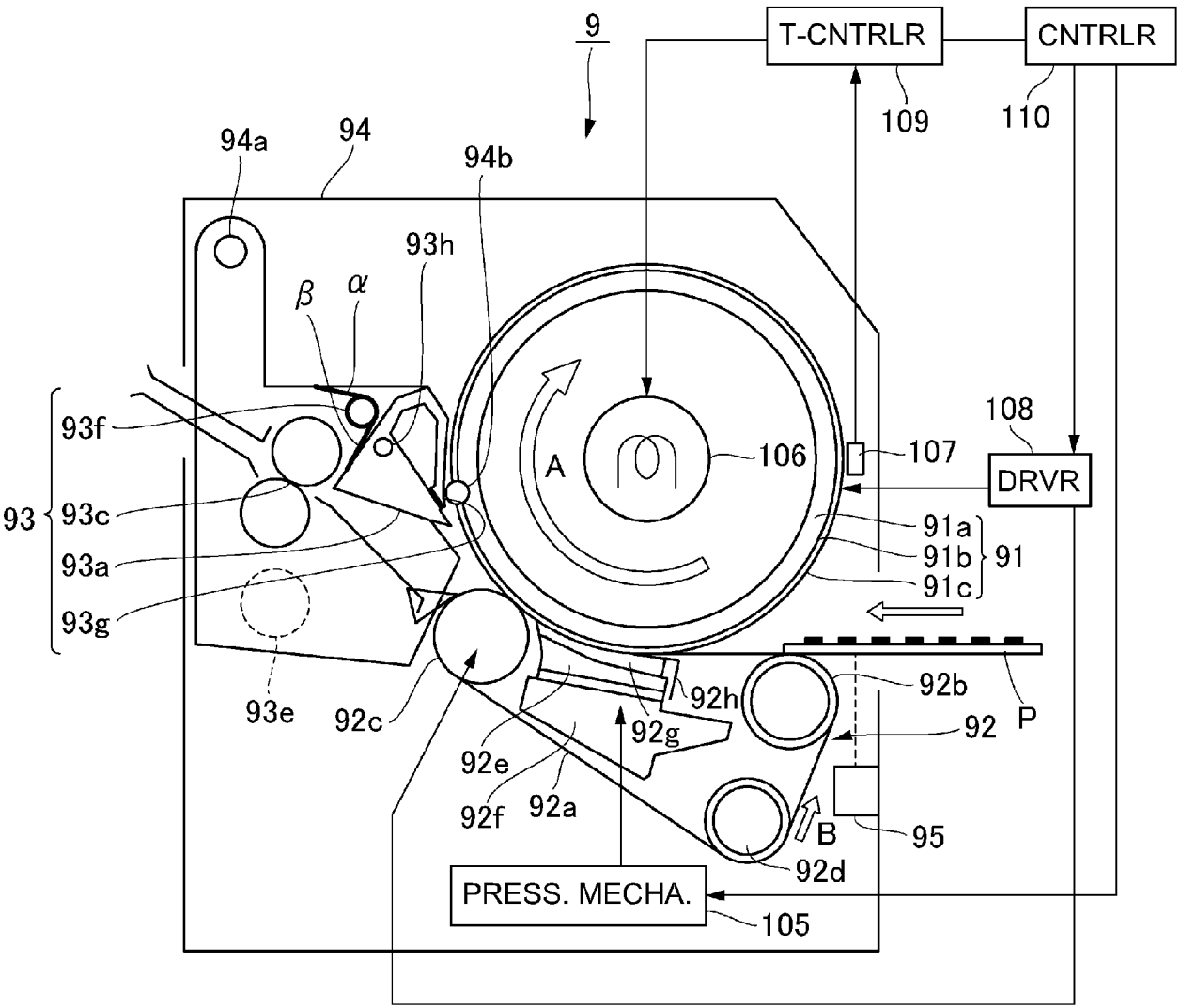
FIG. 2 is a schematic sectional view of the fixing device in the first embodiment, and shows the general structure of the fixing device.

FIG. 2 is a schematic sectional view of the fixing device in this embodiment, which functions as an image heating device. It shows the general structure of the device. Referring to FIG. 2, the fixing device 9 has a pair of rotational members, more specifically, a fixation roller (rotational heating member) 91 and a pressure belt (pressure applying rotational member) 92*a*, which form the nip N1, through which a sheet of recording medium is conveyed while being heated and remaining pinched by the pair of rotational members 91 and 92*a*. The fixation roller 91 and pressure belt 92*a* are kept pressed upon each other, forming thereby the nip N1 between them.

The fixation roller 91 is made up of a cylindrical metallic core 91*a*, a heat resistant and elastic layer 91*b*, and a parting layer 91*c*. The elastic layer 91*b* covers the outward surface of the metallic core 91*a*. The parting layer 91*c* covers the outward surface of the elastic layer 91*b*. The metallic core 91*a* is made of aluminum. It is 77 mm in diameter, 6 mm in thickness, and 350 mm in length. The elastic layer 91*b* is made of such silicon rubber that is 20 degrees in JIS-A hardness scale. It is 1.5 mm in thickness. The parting layer 91*c*, which is for improving the fixation roller 91 in its separability from toner, is formed of fluorinated resin (piece of PFA tube, for example). It is 50 μm in thickness.

The fixation roller 91 is rotatably supported by a fixation device casing 94, in which an image heating unit (image heating portion) is disposed. The fixation roller 91 is driven by a driving portion 108 in the direction indicated by an arrow mark in FIG. 2, at a preset peripheral velocity, which is as high as 500 mm/sec.

There is a heat generating member 106 in the internal hollow of the metallic core 91*a* of the fixation roller 91. The heat generating member 106 is a halogen heater, and is 1,200 W in rated power. The temperature control section 109 controls (turns on or off) the heat generating member 106 so that the surface temperature of the fixation roller 91, which is detected by a thermistor 107, increases to, and remains, at a preset level.

The pressure belt 92*a* is an endless belt, which is 70 mm in external diameter. It is made up of a substrative layer, and an elastic layer formed on the outward surface of the substrative layer. The substrative layer is 100 μm in thickness, and is formed of polyimide. The elastic layer is formed of silicon rubber, and is 200 μm in thickness.

The fixing device 9 is also provided with a combination of an entrance roller 92*b*, a separation roller 92*c*, and a steering roller 92*d*, which support, and keep tensioned, the pressure belt 92*a*. The pressure belt 92*a* is rotated (circularly moved) by the driving force which is inputted into the separation roller 92*c* from a driving portion 108 through an unshown gear train.

The pressure application mechanism 105 keeps the pressure belt unit 92 pressed toward the fixation roller 91, keeping thereby the pressure belt 92*a*, which is supported by the separation roller 92*c* and pressure pad 92*e*, pressed upon the fixation roller 91. The total amount of the pressure applied to the pressure pad 92*e* by the pressure application mechanism 105 is 490 N (50 kgf), and the total amount of pressure applied to the separation roller 92*c* is 490 N (50 kgf).

The pressure application mechanism 105 has an unshown eccentric cam, which moves the pressure belt unit upward to press the pressure belt 92*a* upon the fixation roller 91, or downward to separate the pressure belt 92*a* from the fixation roller 91. The pressure pad 92*e* is made up of a supporting portion 92*f*, a pad 92*g*, and a low friction sheet 92*h*. The supporting portion 92*f* is formed of aluminum. The pad 92*g* is formed of silicon rubber, and is placed on the top surface of the supporting portion 92*f*. The surface of the pad 92*g* is covered with the low friction sheet 92*g*.

The toner image t transferred onto a sheet P of recording medium comes into direct contact with the peripheral surface of the fixation roller 91, in the fixing device 9. Thus, the sheet P tends to adhere to the fixation roller 91 because of the adhesiveness of the melted toner image t. As the sheet P adheres to the fixation roller 91, it is likely to fail to separate from the fixation roller 91 at the exit side of the fixation nip N1, being therefore likely to wrap around the fixation roller 91. If the sheet P wraps around the fixation roller 91, it jams the fixing device 9. Thus, the fixing device 9 fails to process the toner image t on the following sheet P of recording medium (image heating process, that is, image fixing process, is interrupted).

Therefore, the sheet discharge unit (sheet conveyance unit) 93 of the fixing device 9 is provided with an air nozzle (air blowing portion) 93*a*, from which compressed air is blown at the leading edge of the sheet P to force the sheet P to separate from the fixation roller 91. Unlike a recording medium separation mechanism which employs a separation claw formed of heat resistant resin or the like, a recording medium separation mechanism which uses compressed air does not directly rub the surface layer of the fixation roller 91. Further, an operator does not need to be concerned whether or not the toner having adhered to the separation claw contaminates the fixation roller 91. Further, a recording medium separation mechanism such as the one in this embodiment can ensure that even a sheet of recording medium (thin paper, for example) which is very small in basis weight is separated from the fixation roller 91, without being damaged at its leading edge. More specifically, the fixing device 9 is designed so that its recording medium separation mechanism is activated only when a sheet of recording medium which is no more than a preset value in basis weight is conveyed through the fixing device 9 to fix the toner image thereon. On the other hand, when a sheet of recording medium which is no less than a preset value in basis weight is conveyed through the fixing device 9 to fix the toner image thereon, the recording medium separation mechanism is not activated (air is not blown at sheet of recording medium). Instead, the rigidity of the sheet of recording medium is relied upon to separate the sheet from the fixation roller 91.

(Sheet Discharge Unit)

Figure 3:
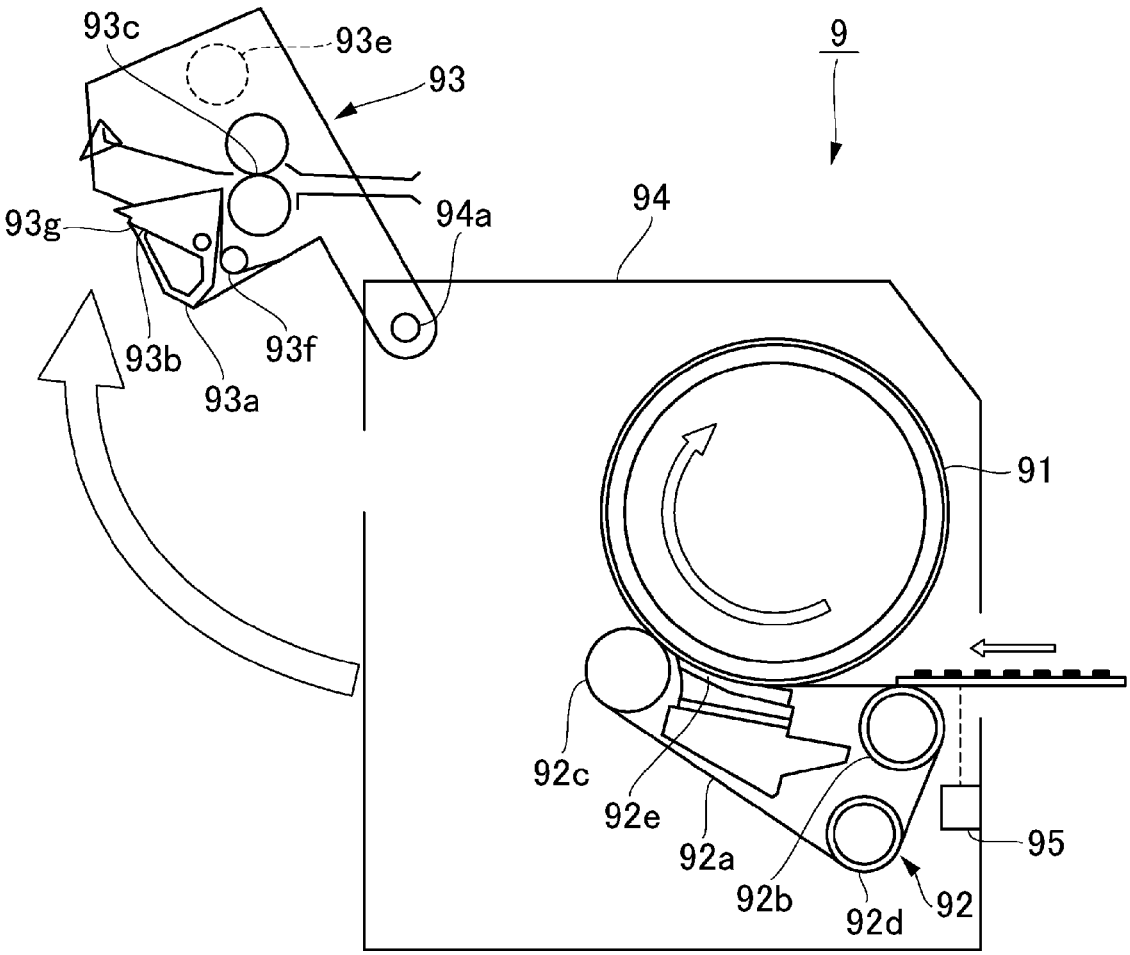
FIG. 3 is a schematic sectional view of the fixing device in the first embodiment, when the sheet discharging unit of the fixing device is in its retraction position, into which it can be pivotally retracted away from the fixation roller.
Figure 4:
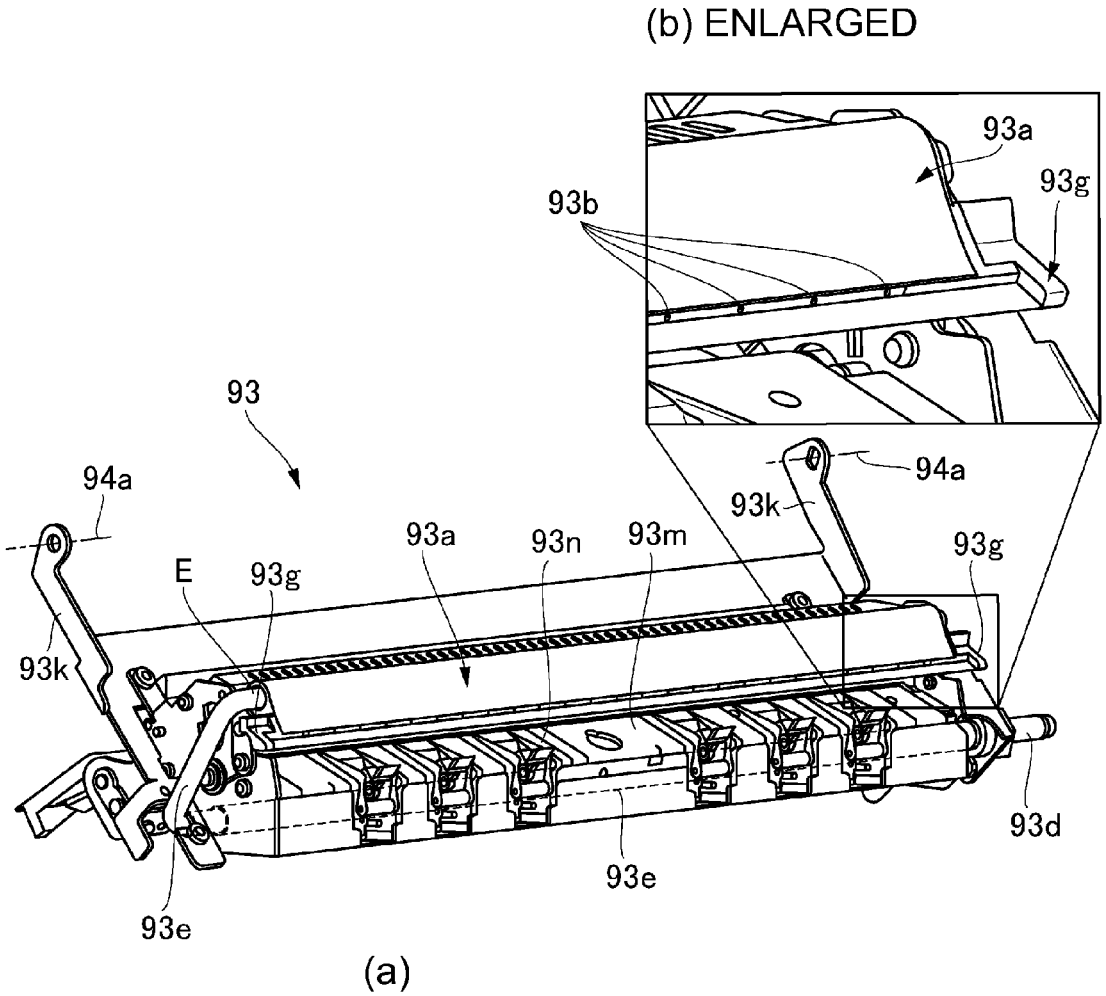
FIG. 4 is a perspective view of the sheet discharging unit.

FIG. 3 is a schematic sectional view of the fixing device 9 in this embodiment, when the sheet discharge unit of the fixing device 9, which functions as a sheet conveyance unit, is in its retraction position, into which it has been pivotally retracted. FIG. 4 is a perspective view of the sheet discharge unit.

Referring to FIG. 2, the sheet discharging unit 93 is rotatably (pivotally) attached to the casing 94 of the fixing device 9. It is provided with an air nozzle 93*a* which functions as an air blowing portion for blowing air at the peripheral surface of the fixation roller 91, on the exit side of the nip N1. The air nozzle 93*a* is provided with multiple air outlets, which are aligned in the lengthwise direction of the fixation roller 91 (direction parallel to axial line of fixation roller 91), and are positioned so that they oppose the fixation roller 92 when the sheet discharge unit is operating. Further, the fixing device 9 is designed so that the air nozzle 93*a* is placed as close as possible to the peripheral surface of the fixation roller 91, in order to maximize the fixing device 91 in the efficiency with which a sheet of recording medium can be separated from the fixation roller 91.

Further, the sheet discharging unit 93 is provided with a pair of sheet conveyance rollers 93*c*, that is, rotational members, which function as a recording medium conveying portion. The pair of sheet conveyance roller 93*c* catch a sheet of recording medium as soon as the sheet comes out of the nip N1 which the fixation roller 91 and pressure belt 92*a* form between them. Then, it conveys the sheet P downstream in terms of the recording medium conveyance direction of the fixing device 9 while keeping the sheet P pinched in its nip N2. Therefore, the fixing device 9 is designed so that the distance between the nip N1 (outlet) and the nip N2 (entrance)

becomes less than the dimension of a sheet of recording medium (smallest among various sheets of recording medium usable with image forming apparatus) in terms of the recording medium conveyance direction. That is, the fixing device 9 is structured so that while a sheet of recording medium is conveyed through the fixing device 9 to fix the toner image t on the sheet, the sheet P remains pinched by at least one of the two nips N1 and N2.

Further, the sheet discharging unit 93, which is provided with the pair of sheet conveyance rollers 93*c* and air nozzle 93*a*, is movable (retractable), along with the pair of sheet conveyance rollers 93*c* and air nozzle 93*a*, in the direction to be moved away from the nip N1 of the fixing device 9. More concretely, it is rotatable (pivotally movable) upward about a pivot 94*a*, relative to the main portion of the fixing device 9, so that it separates from the nip N1. With reference to the recording medium conveyance passage through the nip N1, this pivot 94*a* is on the fixation roller 91 side. Therefore, even if the fixing device 9 is jammed by a sheet of recording medium, a space large enough for a user to deal with the jam can be provided on the downstream side of the nip N1, in terms of the recording medium conveyance direction. Thus, this embodiment can put the fixing device 9 in such a condition that makes it easier for a user to deal with the jam (to remove jammed sheet of recording medium).

When the fixing device 9 is in an operation for image fixation, the pair of recording medium conveyance roller 93*c* convey a sheet P of recording medium outward of the fixing device 9 after the sheet P is conveyed through the nip N1 and separated from the fixation roller 91.

Next, referring to FIG. 3, the sheet discharging unit 93 is attached to the casing 94 of the fixing device 9 so that it can be rotationally (pivotally) moved about the pivot 94*a*. Thus, when it is necessary to remove a sheet of recording medium which is remaining jammed in the fixing device 9, the sheet discharging unit 93 can be rotationally (pivotally) retracted away by an operator from its fixation position to its retraction position.

As the sheet discharging unit 93 is moved into its retraction position, a space large enough to allow an operator to insert operator's hand into the fixing device 9 to remove the jammed sheet of recording medium, is created on the downstream side of the nip N1.

Next, referring to FIG. 4(*a*), the sheet discharging unit 93 is supported by a pair of arms 93*k*, which are rotationally (pivotally) moved about the pivot 94*a*. Thus, it can be rotationally retracted away from the fixation roller 91. Further, the sheet discharging unit 93 is provided with a separation claw which functions as a member for separating a sheet of recording medium from the pressure belt 92*a*. Therefore, as the sheet discharging unit 93 is pivotally retracted away from the casing 94 of the fixing device 9, not only the air nozzle 93*a* and pair of conveyance rollers 93*c*, but also, the separation claw 93*n* are retracted away along with the sheet discharging unit 93, creating thereby the space which is large enough for removing the jammed sheet of recording medium.

The lengthwise ends of the air nozzle 93*a* are provided with a pair of surfaces 93*n* which catch the above described pair of nozzle positioning pins 94*b* (FIG. 2), one for one.

Referring to FIG. 2, the sheet discharging unit 93 is positioned on the downstream side of the nip N1 in terms of the recording medium conveyance direction. It is provided with the air nozzle 93*a*, which is formed of aluminum and is positioned roughly in parallel to the fixation roller 91. When the fixing device 9 is in a fixing operation, compressed air is blown out of the air nozzle 93*a* at a sheet P of recording medium to separate the sheet P from the fixation roller 91 as the sheet P comes out of the nip N1.

From the standpoint of the maximization of the efficiency with which a sheet of recording medium is separated from the fixation roller 91 by the compressed air blown out of the air nozzle 93*a*, it is desired that the air nozzle 93*a*, from which the compressed air is blown, is disposed as close as possible to the peripheral surface of the fixation roller 91.

Therefore, the fixing device 9 is structured so that the air nozzle 92*a* is rotatably (pivotally) movable about the nozzle pivot 93*h* (FIG. 2) relative to the sheet discharging unit 93. More concretely, the air nozzle 93*a* is kept pressured toward the fixation roller 91 by the pressure applied to the air nozzle 93*a* by the flexible end portion β of a torsional coil spring 93*f*, which is in contact with the air nozzle 93*a*. The torsional coil spring 93*f* functions as a pressure applying member. The torsional coil spring 93*f* is attached to the frame of the sheet discharging unit 93, and its flexible end portion α, that is, the opposite flexible end portion of the torsional coil spring 93*f* from the flexible end portion R, is placed in contact with the frame of the sheet discharging unit 93.

Regarding the casing 94 of the fixing device 9, the aforementioned pair of nozzle positioning pins 94*b* are attached to the front and rear walls of the fixation device casing 94, one for one. When the fixing device 9 is in an image fixing operation, the nozzle positioning pins 94*b* are in contact with the pair of pin catching surfaces 93*b* of the air nozzle 93*a*, one for one, positioning thereby the air nozzle 93*a* relative to the fixation roller 91.

However, if the fixing device 9 is jammed during an image forming operation, the image forming apparatus 100 is automatically stopped almost instantly. In such a case, the image forming apparatus 100 cannot be restarted as long as the jammed sheet of recording medium remains in the fixing device 9. To deal with a situation such as this, the image forming apparatus 100 in this embodiment is structured so that the fixing device 9 can be pulled out of the main assembly of the image forming apparatus 100 to remove the jammed sheet of recording medium from the fixing device 9. Further, in consideration of the ease of recording medium removal, and also, ease of visual detection of the state of the jammed sheet of recording medium, it is desired that the air nozzle 93*a* is temporarily retracted away from the fixation roller 91.

Next, referring to FIG. 3, as the sheet discharging unit 93 is rotationally (pivotally) moved about the pivot 94*a* to be retracted away from the fixation roller 91, the air nozzle 93*a* is moved away, along with the pair of conveyance rollers 93*c*, by a substantial distance, by the pivotal movement of the sheet discharging unit 93.

Referring to FIG. 4(*b*), the air nozzle 93*a* is provided with 15-25 nozzle holes 93*b*, which are 0.5-1.0 mm in diameter and open at the nozzle surface, which oppose the fixation roller 91 when the sheet discharging unit 93 is in its fixation position. The compressed air outputted by the compressor 96*a* (which will be described later) which functions as an air supplying portion, fills the interior of the air nozzles 93*a*, and then, blows out of the air nozzle 93*a* through the nozzle holes 93*b*.

The end portion E of the air nozzle 93*a* is in connection to the corresponding end portion of the metallic air delivery tube 93*e* which is in the form of a letter J. The metallic air delivery tube 93*e* is disposed in parallel to the fixation roller 91, and its base portion is in connection with the coupler 93*d* (coupler of sheet discharge unit) for the metallic air delivery tube 93*e*.

The metallic air delivery tube 93*e* is fixedly disposed within the sheet discharging unit 93. Therefore, it does not occur that as the sheet discharging unit 93 is rotationally (pivotally) moved about the pivot 94*a* relative to the fixation device casing 94, the metallic air delivery tube 93*e* is deformed (bent, for example). Further, as the fixing device 9 is pulled out of the image forming apparatus 100, the coupler 93*d* of the air delivery tube 93*e* is disconnected from the corresponding coupler (coupler 96*f* of apparatus main assembly, which will be described later). Therefore, the coupler 93*d* of the air delivery tube 93*e* does not interfere with the rotational (pivotal) movement of the sheet discharging unit 93 about the pivot 94*a*.

(Air Delivery System)

Referring to FIG. 2, there is a recording medium sensor (photo-coupler) 95 on the immediately upstream side of the nip N1. The recording medium sensor 95 detects the timing with which a sheet P of recording medium enters the fixing device 9. The results (detection signals) of the recording medium detection by the recording medium detection sensor 95 are sent to the control section 110.

The air compressor 96*a* is disposed in the casing 100K of the main assembly of the image forming apparatus 100. It generates compressed air having a preset amount of pressure (0.6 MPa). Incidentally, instead of providing the image forming apparatus 100 with the internal air compressor 96*a*, the image forming apparatus 100 may be provided with a buffer tank or an air port to which an external air compressor is connectable.

An electromagnetic pressure relieve valve 96*b* is used to relieve the compressed air in the air delivery tube 96*g* to reduce the air delivery tube 96*g* in internal pressure. An air pressure adjustment value 96*c* adjusts the air delivery tube 96*g* in internal pressure so that the air delivery tube 96*g* remains stable in internal pressure. More concretely, the air pressure adjustment valve 96*g* is to be manually adjusted so that the internal pressure of the air delivery tube 96*g* remains in a range of 0.2-0.3 MPa. An air filter 96*d* removes the condensation, rubbish, dust, and the like contaminants in the air delivery tube 96*g*. An electromagnetic air outlet valve 96*e* is turned on to allow the compressed air to enter the air nozzle 93*a* so that the compressed air blows at the leading edge of a sheet P of recording medium, or turned off to prevent the compressed air from entering the air nozzle 93*a*.

The control section 110 shuts the electromagnetic air relieve value 96*b* after it starts up the air compressor 96*a*. Therefore, the compressed air accumulates in the portion of the air delivery tube 96*g*, which is between the air compressor 96*a* and the electromagnetic air outlet value 96*e*, while being adjusted in pressure to a preset value by the pressure adjustment value 96*c*. Then, as an image forming operation is started, and a sheet P of recording medium begins to be sent into the fixing device 9, the recording medium sensor 95 detects the leading edge of the sheet P. Then, the control section 110 opens the electromagnetic air outlet valve 96*e* after the elapse of a preset length of time from the point in time at which the leading edge of the sheet P was detected. As the electromagnetic air outlet value 96*e* is opened, the compressed air in the air delivery tube 96*g* blows at the leading edge of the sheet P, separating thereby the sheet P from the fixation roller 91.

(Compressed Air Supplying Mechanism)

Figure 6:
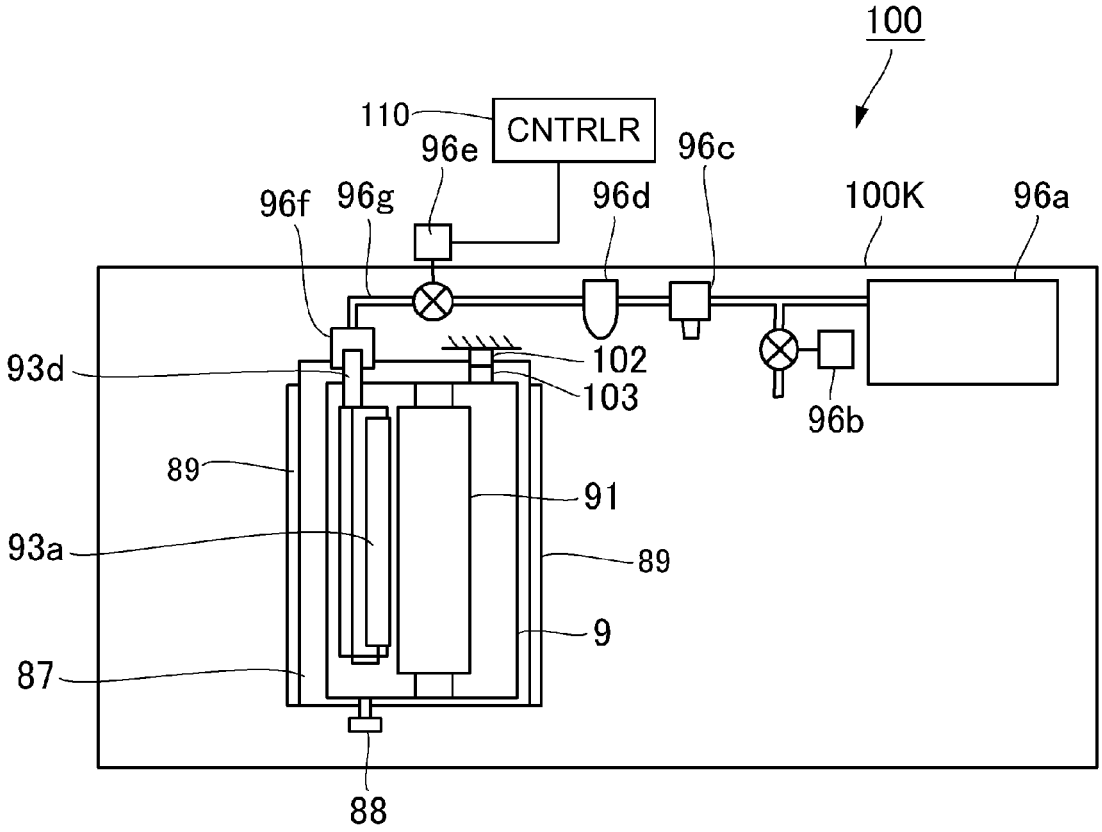
FIG. 6 is a schematic top plan of the combination of the fixing device and air blowing mechanism, in the first embodiment, and shows the structure of the combination, when the air blowing mechanism (unit) is in its air-blowing position.
Figure 7:
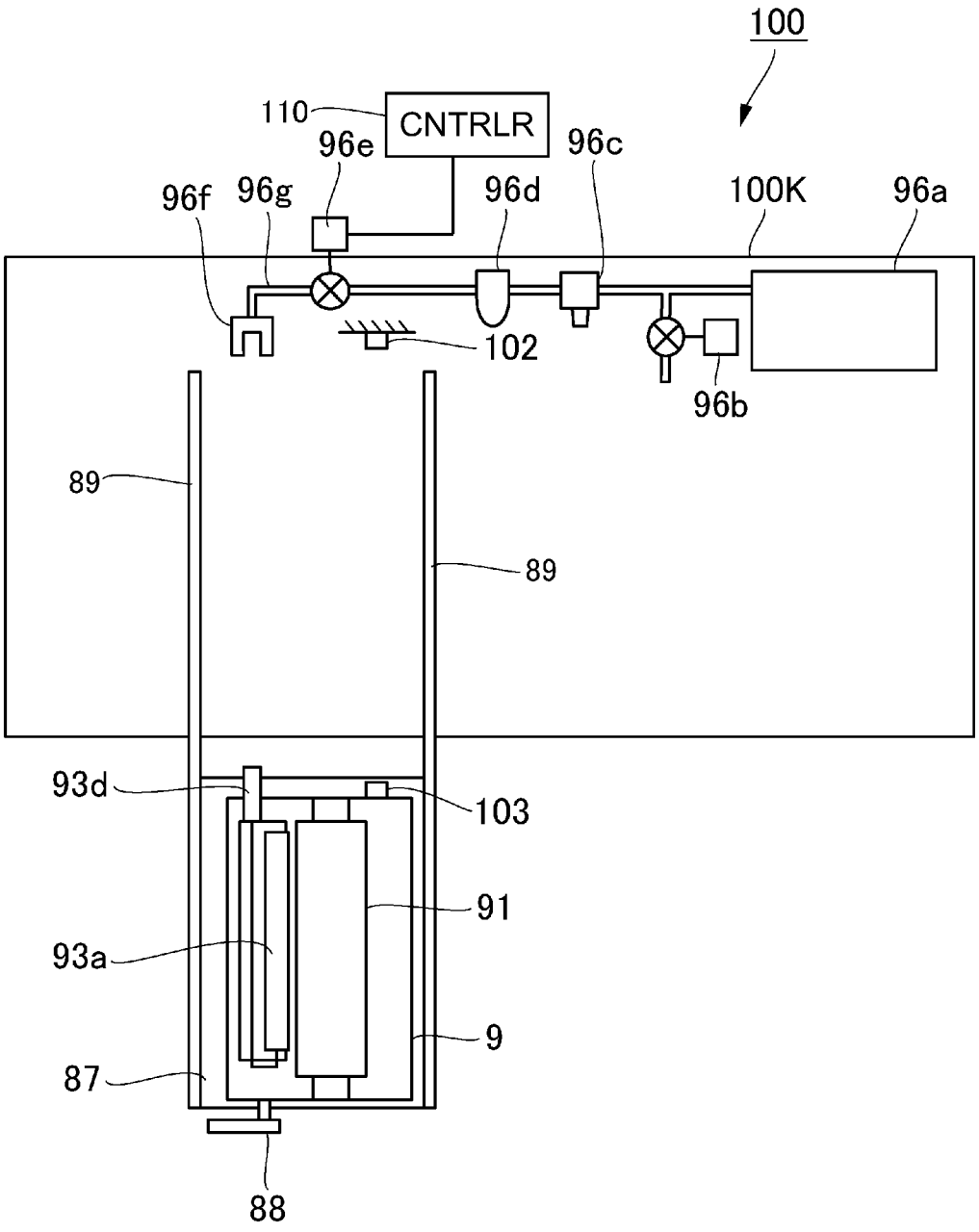
FIG. 7 is schematic top plan of the combination of the fixing device and air blowing mechanism, in the first embodiment, and shows the structure of the combination, when the air blowing mechanism (unit) is in its retraction position.
Figure 8:
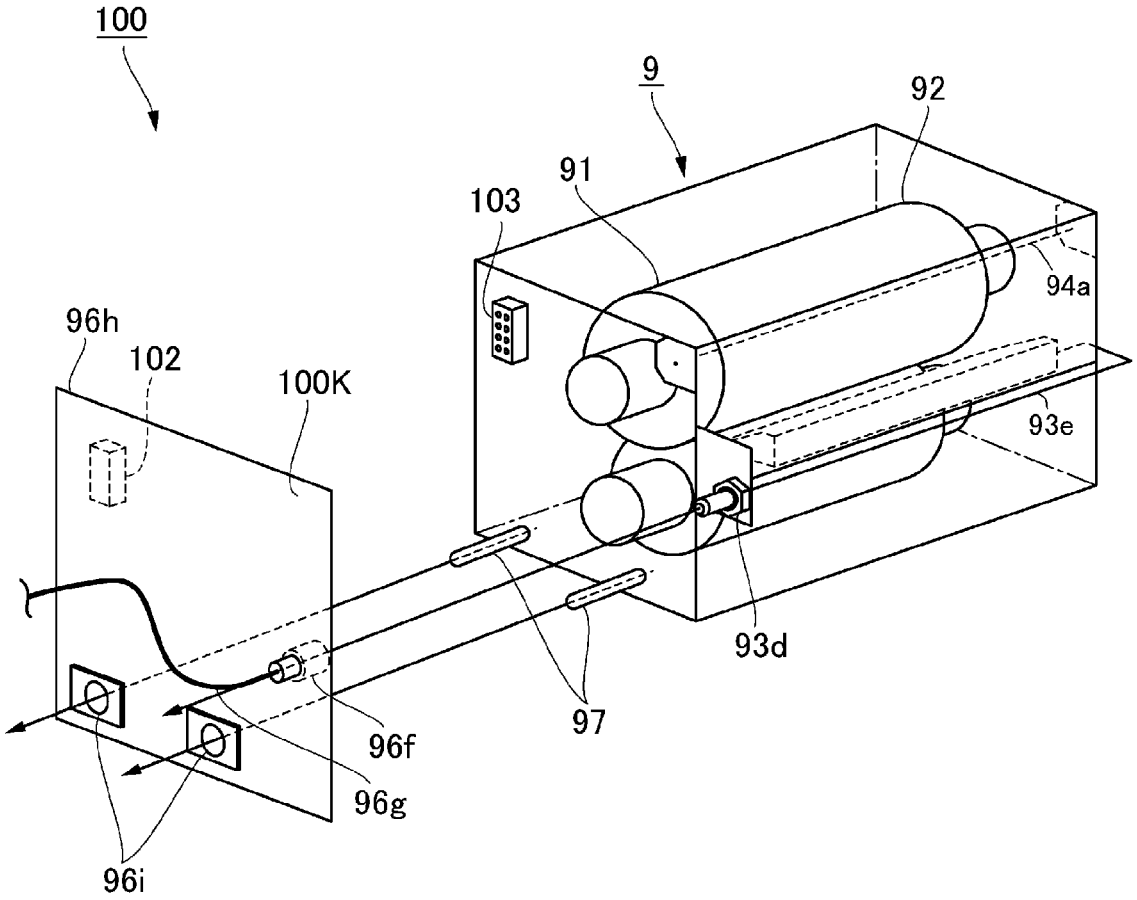
FIG. 8 is a schematic perspective view of the fixing device in the first embodiment, and shows the positioning of the connectors of the air delivery plumbing.
Figure 9:
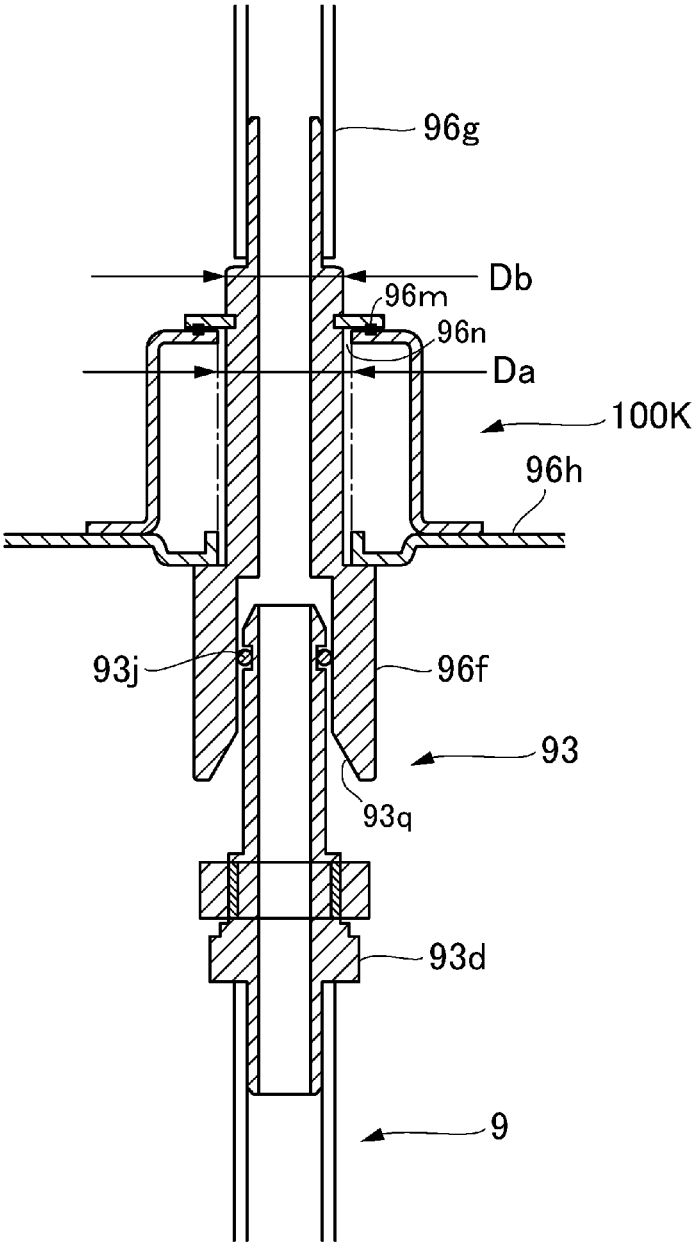
FIG. 9 is a schematic sectional view of the combination of the air delivery tube coupler of the fixing device, and the air delivery tube coupler of the main assembly of the image forming apparatus, and shows the structure of the combination.

FIG. 6 is a schematic top plan view of the combination of the fixing device and compressed air supplying mechanism of the image forming apparatus 100, when the fixing device 9 is in the casing 100K (main assembly) of the image forming apparatus 100. FIG. 7 is a schematic top plan view of the combination of the fixing device and compressed air supplying mechanism of the image forming apparatus 100 in this embodiment, when the fixing device 9 is out of the main assembly (casing 100K) of the image forming apparatus 100. FIG. 8 is a schematic, perspective, phantom, and partially broken view of the fixing device 9 in this embodiment. It shows the positioning of the air delivery plumbing and its connectors of the device 9. FIG. 9 is a drawing for describing the structure of the connectors of the air delivery plumbing of the image forming apparatus 100.

Referring to FIG. 6, the slide rail 89, which is a part of a fixing device supporting mechanism, supports the fixing device 9 in such a manner that the fixing device 9 can be pulled out of the image forming apparatus casing 100K in the direction which is practically in parallel to the axial line of the fixation roller 91. The compressor 96*a* is within the casing 100K, and supplies the fixing device 9 with highly compressed air. The coupler 96*f*, which functions as the connector on the main assembly side of the image forming apparatus 100 is in connection with the compressor 96*a* by way of the air delivery tube 96*g*. The coupler 93*d*, which functions as the connector of the sheet discharge unit side of the fixing device 9, is in the sheet discharging unit 93, and is in connection with the air nozzle 98*a* by way of the metallic air delivery tube 93*e*.

Referring to FIG. 7, as the fixing device 9 is pulled out of the casing 100K of the main assembly of the image forming apparatus 100, more specifically, as the sheet discharging unit 93 is pulled out, along with the fixation roller 91 and pressure belt 92*a*, from the casing 100K, the coupler 93*d* of the fixing device 9 is separated from the coupler 96*f* of the main assembly 100K, by the outward movement of the fixing device 9. Thus, the air delivery plumbing of the fixing device 9 is separated from the air delivery pluming of the main assembly of the image forming apparatus 100. Next, referring to FIG. 9, as the fixing device 9 is moved (pushed) back into the casing 100K, the coupler 93*d* of the fixing device 9 becomes connected to the coupler 96*f* of the main assembly of the image forming apparatus 100.

Next, referring to FIG. 8, the coupler 93*d* of the fixing device 9 is positioned away from the axial line of the pivot 94*a* in terms of the direction parallel to the recording medium conveyance direction. Further, the sheet discharging unit 93 is provided with the metallic air delivery tube 94*c*, which is an example of stationary plumbing. The metallic air delivery tube 93*e* is in connection to the coupler 93*d* of the fixing device 9. It is extended from the coupler 93*d* of the fixing device 9 to the opposite end of the fixation roller 91 from the coupler 93*d*, in terms of the direction parallel to the axial line of the fixation roller 91, where it is in connection to the coupler 93*d* of the fixing device 9, which is in connection to the air nozzle 93*a*.

Referring to FIG. 1, there is disposed a recording medium sensor (photo-interrupter) 12*a*, on the upstream side of the pair of registration rollers 12. Further, there is disposed a recording medium sensor (photo-interrupter) 7*a* on the downstream side of the fixing device 9. Thus, if a sheet P of recording medium does not arrive at the recording medium sensor 7*a* within a preset length of time after the sheet P moved past the recording medium sensor 12*a* during an image forming operation, the control section 110 determines that the sheet P became jammed somewhere in the image forming apparatus 100, and interrupts the image forming operation. This is when the fixing device 9 is to be pulled out of the image forming apparatus 100 in the frontward direction so that the jammed sheet P of recording medium in the fixing device 9 can be manually removed. Incidentally, it is also for the maintenance of the fixing device 9 that the fixing device 9 is to be pulled out of the image forming apparatus 100 in the same manner.

Next, referring to FIG. 6, the fixing device 9, more specifically, a combination of the image heating unit 94 (combination of various image fixation mechanisms, and casing which contains various mechanisms) and recording medium conveyance unit 93 is mounted on the fixation device stand 87, which functions as a drawer. The fixing device stand 87 is supported by the pair of slide rails 89. Therefore, the fixing device stand 87 is movable in a sliding manner in the direction which is practically parallel to the rotational axis of the fixation roller 91. A handle 88 functions also as a part of the mechanism which keeps the fixing device 9 locked to the inward surface of the rear wall of the casing 100K of the image forming apparatus 100.

FIG. 7 shows the state of the image forming apparatus 100, in which the fixing device 9 is in its outermost position into which it was pulled out of the casing 100K of the image forming apparatus 100. The procedure for removing a jammed sheet of recording medium in the fixing device 9 is as follows. First, an operator is to rotate the handle 88, which is in the state shown in FIG. 6, 90 degrees to unlock the fixing device 9. Then, the operator is to pull frontward the handle 88. As the handle 88 is pulled frontward, the fixing device stand 87 on which the fixing device 9 is resting, is pulled out frontward of the casing 100K, along the pair of slide rails 89. Then, after the fixing device 9 is completely pulled out of the casing 100K, the operator is to rotationally (pivotally) retract the sheet discharging unit 93 as shown in FIG. 3. As the sheet discharging 93 is rotationally (pivotally) retracted, a space large enough for the jammed sheet of recording medium to be removed is created between the fixation roller 91 and sheet discharging unit 93. By the way, referring to FIG. 2, as the printing operation of the image forming apparatus 100 is interrupted, the control section 110 activates the pressing mechanism 105 to separate the pressure belt 92*a* from the fixation roller 91.

Further, in this embodiment, the image forming apparatus 100 is structured so that when the fixing device stand 87 is in its image fixation position in the casing 100K of the image forming apparatus 100, which allows the fixing device 9 to operate (when coupler of main assembly and coupler of fixing device are in connection to each other), the sheet discharging unit 93 cannot be rotationally moved. More concretely, when the fixing device stand 87 is in the above described condition, the sheet discharging unit 93 remains locked by a locking mechanism so that it is not allowed to rotationally move. This locking mechanism can be unlocked by the rotational movement of the above-described handle 88.

The coupler 96*f* of the main assembly of the image forming apparatus 100 is supported by the main assembly casing 100K, with the provision of a preset amount of play between the coupler 96*f* and casing 100K. The compressed air is supplied to the fixing device through the air delivery tube 96*g*. The coupler 96*f* of the apparatus main assembly is such a coupler that is to be engaged with the coupler 93*d* of the fixing device 9 to deliver the compressed air to the air nozzle 93*a* in the sheet discharging unit 93.

The coupler 93*d* of the fixing device is rigidly (with no play) fixed to the sheet discharging unit 93. That is, it is a part of the air delivery plumbing of the fixing device 9, which delivers the compressed air from itself to the air nozzle 93*a*. Therefore, as the coupler 93*d* of the fixing device is separated from the coupler 96*f* of the apparatus main assembly, the sheet discharging unit 93 become free to be rotationally moved relative to the fixing device casing 94.

As for the air delivery tube 96*g* of the main assembly, it is fixed to the main assembly casing 100K up to the coupler 96*f* of the apparatus main assembly. Therefore, it does not occur that when the sheet discharging unit 93 is rotationally retracted, the air delivery tube 96*g* interferes with the rotational movement of the sheet discharging unit 93, and the tube 96*g* is elastically deformed by its contact with the tube 96*g*. That is, even if the sheet discharging unit 93 is repeatedly moved in the rotational manner, the air delivery tube 96*g* is not going to be damaged.

The operation for moving the fixing device 9 back into the image forming apparatus 100 after the completion of the operation for removing the jammed sheet of recording medium from the fixing device 9 is as follows. First, the operator is to push the fixing device 9 inward of the image forming apparatus 100 by the handle 88, so that the fixing device stand 87, on which the fixing device 9 is present, moves into the image forming apparatus 100, while being guided by the pair of slide rails 89. As the fixing device stand 87 is pushed into the image forming apparatus 100, the coupler 93*d* of the fixing device 9 is inserted into the coupler 96*f* of the apparatus main assembly, connecting thereby the air delivery plumbing of the fixing device 9 to the air delivery plumbing of the apparatus main assembly. Then, the operator is to rotate 90 degrees the handle 88, which is in the state shown in FIG. 7, to lock the fixing device 9 to the main assembly casing 100K.

Referring to FIG. 8, the fixation device casing 94 is provided with a pair of positioning pins 97 and an electrical connector 103, whereas the main assembly casing 100K is provided with a pair of tapered holes 96*i* which function as the positioning holes, and an electrical connector 102.

Therefore, as the fixing device 9 is slid into the image forming apparatus 100 along the pair of slide rails 89, and repositioned in the image forming apparatus 100, the pair of positioning pins 97 fit into the tapered positioning holes 96*i*, one for one, and the connector 103 of the fixing device 9 is connected to the electrical connector of the main assembly.

A length L1 by which the positioning pins are inserted into the tapered holes 96*i* is greater than a length L2, by which the coupler 93*d* of the fixing device 9 is inserted into the coupler 93*f* of the apparatus main assembly. Further, the length L2 is greater than a length L3 by which the connector 103 of the fixing device 9 is inserted into the connector 102 of the apparatus main assembly. That is, there is a following relationship among the length L1 by which the positioning pins 97 are inserted, the length L2 by which the coupler 93*d* of the fixing device is inserted, and the length L3 by which the connector 102 of the apparatus main assembly is inserted: L1>L2>L3.

As the fixing device 9 is pushed into the apparatus main assembly, the positioning pins 97 are inserted into the tapered holes 96*i* of the coupler 96*f* of the apparatus main assembly, following the surface of the tapered hole 96*i*, and therefore, being reduced in its play relative to the main assembly casing 100K. Consequently, the fixing device 9 is properly positioned relative to the apparatus main assembly casing 100K. As the positioning pins 97 are inserted into the tapered positioning hole 96*i* as far as possible, the fixing device 9 is positioned relative to the main assembly of the image forming apparatus 100. Then, as the fixing device 9 is pushed farther into the apparatus main assembly, the coupler 93*d* of the fixing device 9 engages with the coupler 96 of the apparatus main assembly.

That is, as the fixing device 9 is pushed into the apparatus main assembly, first, the positioning pins 97 fit into the positioning hole 96*i* of the main assembly casing 100K. Then, the coupler 93*d* of the fixing device 9 begins to enter the coupler 93*d* of the apparatus main assembly. Then, the connector 103 of the fixing device 9 engages with the connector 102 of the apparatus main assembly, ending thereby the positioning of the fixing device.

Referring to FIG. 9, the coupler 96*f* of the apparatus main assembly is attached to the main assembly casing 100K, with the provision of a preset amount of play between the coupler 96*f* and main assembly casing 100K, in terms of the direction perpendicular to the axial line of the fixation roller 91. Thus, the coupler 96*f* is allowed to be moved in the direction perpendicular to the axial line of the fixation roller 91. When the coupler 93*d* of the fixing device 9 is engaged with the coupler 93*f* of the main assembly casing 100K, the coupler 93*d* is moved into the coupler 93*f* which is remaining stationary. Further, the coupler 93*d* of the fixing device 9 is fitted with an O-ring 93*j*. Therefore, as the coupler 93*d* of the fixing device 9 is inserted into the coupler 93*f* of the apparatus main assembly, the O-ring 93*j* is compressed by the inward surface of the coupler 96*f* of the apparatus main assembly, ensuring that the joint between the two couplers 96*d* and 96*f* remains perfectly sealed.

The entrance portion 93*q* of the engagement hole of the coupler 96*f* of the apparatus main assembly is tapered so that as the end of the coupler 93*d* of the fixing device 9 comes into contact with the wall of the tapered portion 93*q* of the engagement hole of the coupler 96*f* of the apparatus main assembly, it is guided toward the center of the engagement hole of the coupler 96*f* of the apparatus main assembly. Further, the coupler 96*f* of the apparatus main assembly is put through the through hole of the frame 96*h* of the apparatus main assembly, which is Da in diameter, with the placement of a rubber sheet 96*m* between the coupler 96*f* and frame 96*h*. The portion of the coupler 96*f* of the apparatus main assembly, which is in the through hole of the frame 96*h* of the apparatus main assembly, is Db in diameter. The diameter of the hole of the frame 96*h* of the apparatus main assembly is greater than that of the diameter of the portion of the coupler 96*f* of the fixing device 9, which is in the through hole of the frame 9*h* of the apparatus main assembly (Da>Db). Therefore, the coupler 96*f* of the apparatus main assembly, which is positioned relative to the apparatus main assembly, with the placement of the rubber sheet 96*m* between itself and the apparatus main assembly, in such a manner that its axial line coincides with the axial line of the through hole 96*n* of the apparatus main assembly, is allowed to move relative to the frame 96*h* of the apparatus main assembly in the radius direction of the hole 96*n*, within a range (Da-Db).

It is possible that as the fixing device 9 is moved back into the image forming apparatus 100, and positioned relative to the image forming apparatus 100, after being pulled out of the image forming apparatus 100, the coupler 93*d* of the fixing device 9 will be positioned slightly offset from its position designated by the design of the image forming apparatus 100, because of the tolerance in the dimension of the components of the image forming apparatus 100 (fixing device 9) and/or positioning errors which might occur during the assembly of the image forming apparatus 100 (fixing device 9). This is why there is provided the aforementioned play of (Da-Db) to ensure that the coupler 96*d* of the fixing device 96*f* properly engages with the coupler 96*f* of the apparatus main assembly, regardless of the above described tolerance and/or errors.

As described above, in this embodiment, a sheet of recording medium is forcefully separated from the fixing device 91 by the compressed air which rushes out of the air nozzle 93*a*. Further, the image forming apparatus 100 is structured so that the sheet discharging unit 93, by which the air nozzle 93*a* and pair of sheet conveyance rollers 93*c* are held, can be rotationally (pivotally) retracted away from the fixing device casing 94. Therefore, it is ensured that when it is necessary to remove a jammed sheet of recording medium in the fixing device 9, a space which is large enough for the jammed sheet to be easily removed can be provided on the downstream side of the fixation roller 91 in terms of the recording medium conveyance direction.

When it is necessary to remove a jammed sheet of recording medium in the fixing device 9, the fixing device stand 87 is to be pulled out of the main assembly (100K) of the image forming apparatus 100. As the stand 87 is pulled out, the coupler 93*d* of the fixing device 9 is disengaged (separated) from the coupler 96*f* of the apparatus main assembly. Thereafter, the sheet discharge unit 93 is to be rotationally (pivotally) retracted away from the fixation roller 91.

That is, this embodiment makes unnecessary the operations of which an image forming apparatus (fixing device) based on the prior art is required, that is, the operation which has to be carried out to connect the coupler 93*d* of the fixing device 9 with the coupler 96*f* of the apparatus main assembly after the fixing device 9 is pushed back into the apparatus main assembly, and the operation which has to be carried out to disconnect (separate) the coupler 93*d* of the fixing device 9 from the coupler 96*f* of the apparatus main assembly after the fixing device 9 is pulled out of the apparatus main assembly. In other words, this embodiment can eliminate the apprehension that an operator may forget to connect the coupler 96*d* of the fixing device 9 to the coupler 96*f* of the apparatus main assembly after the operator pushes back the fixing device stand 87 into the apparatus main assembly.

Embodiment 2

Figure 5:
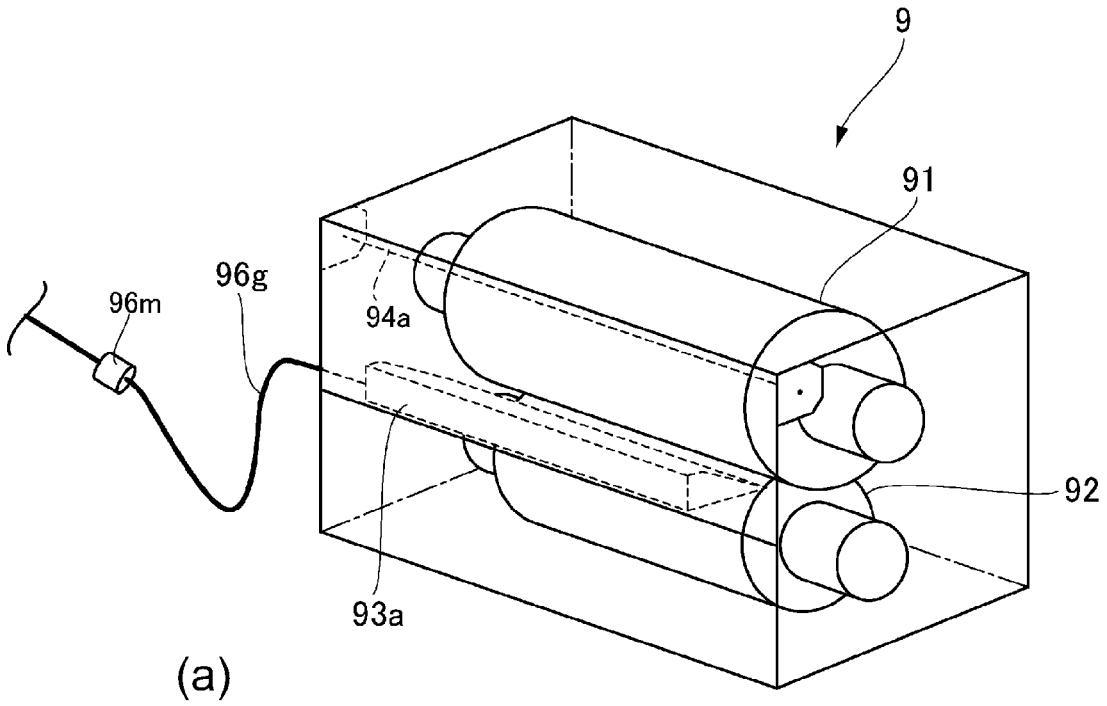
FIG. 5 is a schematic, perspective, and phantom view of the fixing device in the second embodiment, and shows the structural arrangement of the fixing device, which allows the air nozzle of the fixing device to be retracted away from the fixation roller.
Figure 5:
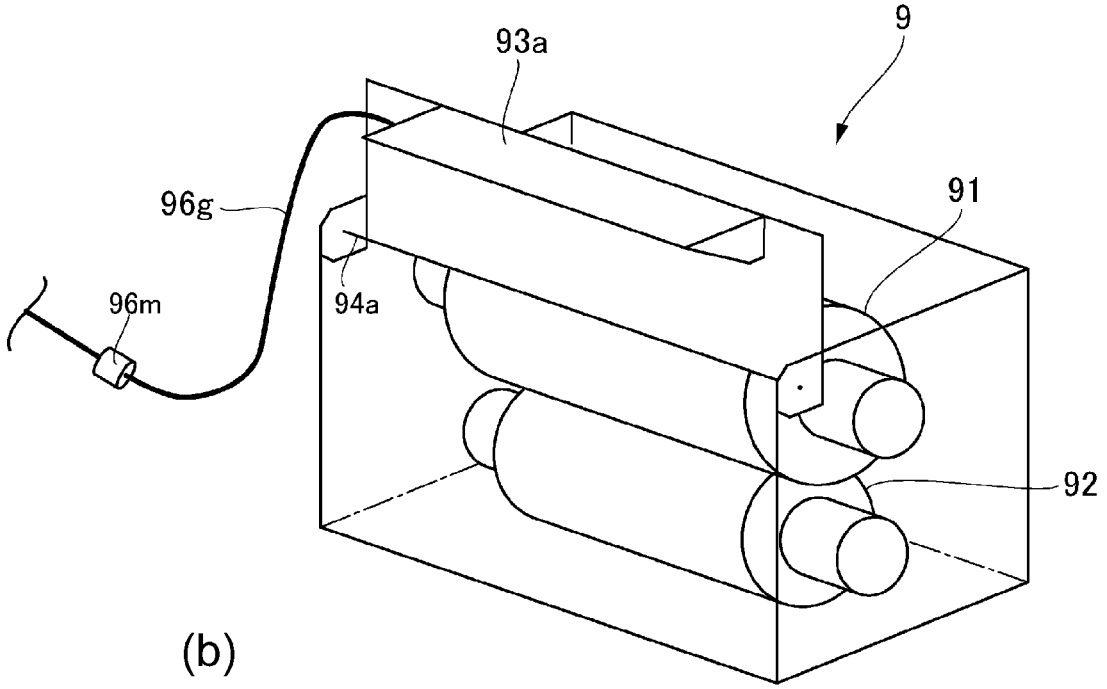

Next, referring to FIG. 5, the second embodiment of the present invention is described. The components of the image forming apparatus (fixing device) in this embodiment, which are the same in function as the counterparts in the first embodiment, are given the same referential codes as those given to the counterparts, and are no going to be described in detail, here. FIG. 5 is a schematic, phantom, and perspective view of the fixing device in this embodiment. It shows the structural arrangement of the fixing device, which is for retracting the air nozzle of the fixing device. FIG. 5(*a*) shows the fixing device when the device is being used for an image forming operation, and FIG. 5(*b*) shows the fixing device when the device is ready for the removal of a jammed sheet of recording medium in the device.

The essential difference of this embodiment from the first embodiment is as follows. In this embodiment, couplers such as those used in the first embodiment were not used. Instead, a piece of flexible tube was used to connect the air compressor of the apparatus main assembly to the air nozzle of the fixing device, in order to make it unnecessary to separate the coupler of the fixing device from the coupler of the apparatus main assembly.

Referring to FIG. 5(*a*), the image forming apparatus 100 is structured so that during an image forming apparatus, the air nozzle 93*a* is in the adjacencies of the fixation roller 91 in the fixing device 9. The air nozzle 93 is in connection to the flexible air tube 03*g*, which is in connection to the air compressor (compressed air source) in the main assembly of the image forming apparatus 100.

Referring to FIG. 5(*b*), in the case of the fixing device in this embodiment, as the air nozzle 93*a* is rotationally (pivotally) retracted to remove a jammed sheet of recording medium in the fixing device, the air delivery tube 96*g* can elastically deform, because it is flexible.

As described above, the image forming apparatus (fixing device) in this embodiment is structured so that the air nozzle 93*a* and pair of sheet conveyance roller 93*c* are held by the sheet discharging unit 93, which can be retracted away from the fixation roller 91. Therefore, it is ensured that a space large enough for a jammed sheet of recording medium to be easily removed can be provided, as in the first embodiment.

Incidentally, in the case of this embodiment, the air delivery tube 96*a*, through which the compressor in the apparatus main assembly of the image forming apparatus 100 is in connection to the fixing device of the image forming apparatus 100, is flexible, and therefore, does not need to be disconnected from the sheet discharge unit 93 to allow the sheet discharging unit 93 to be retracted. However, each time the fixing device is moved out of the apparatus main assembly, the air delivery 96*a* is flexed. Therefore, eventually, it becomes permanent deformed. That is, it is possible that the air delivery tube 96*a* will suffer from such problems as changing in plasticity and/or being pinched between the fixing device stand 87 and main assembly casing 100K. Therefore, the first embodiment is preferable from standpoint of image forming apparatus structure.

Further, because the space available in an image forming apparatus is limited in size, the air delivery tube 96*g* has to be limited in length. Therefore, it is possible that this limitation in the length of the air delivery tube 96*g* will limit the distance by which the sheet discharging unit 93 (air nozzle 93*a*) can be retracted away from the fixation roller 91. Therefore, the first embodiment is preferable to the second embodiment, in terms of the structural arrangement of an image forming apparatus (fixing device).

The foregoing are the description of the present invention with reference to first and second embodiments of the present invention. However, these embodiments are not intended to limit the present invention in scope in terms of the structure of an image forming apparatus. That is, the present invention encompasses various known image forming apparatuses (fixing devices) which are different in structure from those in the first and second embodiments.

For example, the mechanism for heating a fixation roller is not limited to a halogen heater such as the above described one. That is, the present invention encompasses a fixing device which employs an excitation coil to inductively heat a fixation roller. Further, the fixation roller may be replaced with an endless belt suspended, and kept stretched, by multiple rotational members. Similarly, the pressure belt may be replaced by a pressure roller. Further, the object at which compressed air is blown may be the pressure belt in addition to the fixation roller.

Further, in the foregoing, the fixing device was described as an image heating device for fixing the toner image on a sheet of recording medium. However, the present invention encompasses an image heating apparatus which is used to temporarily fix an unfixed toner image, an image heating apparatus which is used to adjust a fixed image in surface properties such as gloss.

Further, an image forming apparatus which the present invention encompasses is not limited to a full-color image forming apparatus such as the one described above. That is, the present invention encompasses a monochromatic image forming apparatus as well. Further, the present invention encompasses a copying machine equipped with an original reading device, a facsimile machine which transmits or receives an image, a multifunction machine capable of functioning as two or more of the preceding machines, in addition to the above described printer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 265209/2012 filed Dec. 4, 2012 which is hereby incorporated by reference.

What is claimed is:

1. An image forming apparatus comprising:

a main assembly of the apparatus provided with an air supply portion configured to supply air, and a main assembly side connector connected to said air supply portion;

an image heating unit including a pair of rotatable members between which a sheet is nipped and fed while heating a toner image thereon;

a retracting unit retractable from said image heating unit, said retracting unit including an air discharging portion configured to discharge air for separating the sheet from at least one of said rotatable members, and a feeding portion provided with a pair of rotatable members and configured to nip and feed therebetween the sheet heated by said image heating unit;

a drawing unit supporting said image heating unit and said retracting unit and drawable relative to said main assembly of the apparatus; and a unit side connector provided on said retracting unit and connectable to said main assembly side connector with an operation of inserting said drawing unit into said main assembly of the apparatus.

2. An apparatus according to claim 1, wherein said unit side connector is released from said main assembly side connector in accordance with an operation of drawing said drawing unit out of said main assembly of the apparatus.

3. An apparatus according to claim 1, wherein said retracting unit is retractable from said image heating unit by rotation around a predetermined rotational center.

4. An apparatus according to claim 3, wherein the rotational center is disposed on a side of said apparatus, with respect to a sheet feeding path, where at least one of the rotatable members of said image heating unit contactable with the toner image on the sheet is provided.

5. An apparatus according to claim 4, wherein said air discharging portion discharges the air toward at least one of said rotatable members of said image heating unit contactable with the toner image on the sheet.

6. An apparatus according to claim 5, wherein said retracting unit includes a separating member configured to separate the sheet from said at least one rotatable member of said image heating unit which is not contactable to the toner image on the sheet.

7. An apparatus according to claim 6, wherein the toner image on the sheet is an unfixed toner image.

8. An apparatus according to claim 1, wherein the distance between a nip between said rotatable members of said image heating unit and a nip between said rotatable members of said feeding portion, measured along a sheet feeding direction is shorter than the length of the sheet measured in the sheet feeding direction.

9. An apparatus according to claim 1, wherein said air discharging portion includes a plurality of discharging outlets configured to permit discharge of the air, said discharging outlets being provided at different positions with respect to a longitudinal direction of said rotatable members of said image heating unit.

10. An apparatus according to claim 1, wherein said air supply portion includes a compressor, a relaying portion configured to relay air from said compressor to said main assembly side connector, and a valve configured to switch said relaying portion between a state permitting supply of the air to said main assembly side connector and a state shutting off the supply of the air.

11. An apparatus according to claim 1, further comprising a positioning pin provided on said drawing unit, a positioning hole provided in said main assembly of the apparatus and configured to receive said positioning pin, wherein with an inserting operation of said drawing unit, said positioning pin and said positioning hole are engaged with each other, and then said unit side connector is connected to said main assembly side connector.

12. An apparatus according to claim 11, wherein said main assembly side connector is supported by said main assembly of the apparatus with a predetermined play, and said unit side connector is rigidly supported by said drawing unit.

* * * * *